United States Patent [19]

Timmons

[11] 4,007,770

[45] Feb. 15, 1977

[54] SEMI-CONSUMABLE ELECTRODE VACUUM ARC MELTING PROCESS FOR PRODUCING BINARY ALLOYS

[75] Inventor: George A. Timmons, Ann Arbor, Mich.

[73] Assignee: Amax Inc., New York, N.Y.

[22] Filed: Mar. 5, 1975

[21] Appl. No.: 555,608

[52] U.S. Cl. ..... 164/52; 75/10 R; 164/57

[51] Int. Cl.[2] ..... B22D 27/02; C22B 4/06

[58] Field of Search ..... 75/10, 129, 130, 65; 164/52, 57

[56] References Cited

UNITED STATES PATENTS

| | | | |
|---|---|---|---|
| 3,529,958 | 9/1970 | Buehler | 164/57 |
| 3,905,803 | 9/1975 | Bianchi | 164/52 |

*Primary Examiner*—P. D. Rosenberg
*Attorney, Agent, or Firm*—Harness, Dickey & Pierce

[57] ABSTRACT

A process for producing homogeneous binary alloys comprised of a first element present in a major amount having a melting point below the liquidus of the binary alloy and a second element present in a minor amount having a melting point above the liquidus of the binary alloy, whereby the second element is formed into a semi-consumable electrode and is employed to melt the first element progressively fed into a crucible or mold. The power for forming the high energy electric arc is controlled to maintain a molten pool in the crucible and to effect a progressive melting of the semi-consumable electrode, whereby liquid droplets of the higher melting alloy enter and become substantially completely dissolved in the molten pool at a controlled rate in consideration of the rate of feed of the first element to provide a resultant binary alloy having the desired proportion of the two alloying elements. The process is particularly applicable for producing homogeneous ingots of titanium-molybdenum binary alloys.

12 Claims, 2 Drawing Figures

SEMI-CONSUMABLE ELECTRODE VACUUM ARC MELTING PROCESS FOR PRODUCING BINARY ALLOYS

BACKGROUND OF THE INVENTION

The process of the present invention is particularly applicable but not necessarily restricted to the procedure of binary titanium-molybdenum alloys containing from about 5% up to about 40% molybdenum which are characterized as being substantially homogeneous and devoid of any segregations resulting from undissolved pure molybdenum particles present in the microstructure. Titanium-molybdenum alloys containing molybdenum within a range of about 15 to about 40% are referred to as beta-alloys in that they retain a cubic structure at room temperature. Such alloys containing from about 15 up to about 30% molybdenum are recognized as possessing excellent resistance to corrosion by sodium chloride solutions, as well as exceptional resistance to corrosion by boiling hydrochloric acid and boiling sulfuric acid. The molybdenum constitutent imparts improved strength and enhances the corrosion resistance of such titanium-based alloys. Although these alloys have excellent potential for a number of commercial applications, the production and marketing of titanium-molybdenum alloys have been retarded due to the difficulty encountered in accordance with the prior art practices in obtaining a complete dissolution of the molybdenum in the binary alloy matrix.

It has heretofore been proposed to produce such titanium-molybdenum binary alloys by employing conventional consumable electrode arc melting processes in which the consumable electrode is composed of titanium sponge admixed with particulated molybdenum to produce the desired ratio of the two alloying elements desired in the final binary alloy. A high-energy arc is formed between the end of the consumable electrode and the metal bath within a water-cooled copper crucible or mold. As soon as the titanium metal at the end of the consumable electrode reaches its melting point (1670° C), the titanium becomes liquid and drops into the bath. The molten metal in the bath is only slightly above the melting point of titanium and it is not possible to develop sufficient superheating of either the electrode or the bath to effect a melting of the molybdenum constituent. Accordingly, as the titanium in the electrode melts, the molybdenum particles are released and fall from the electrode as a solid and enter the molten bath in a solid phase. While some dissolution of the molybdenum particle into the molten titanium occurs, the binary alloy formed immediately adjacent to, and surrounding, the molybdenum particle, having a solidus temperature above the melting point of titanium, solidifies, whereby further dissolution of the molybdenum particle ceases. The casting therefore retains undissolved particles of molybdenum metal and/or localized zones of molybdenum contents far above the molybdenum content of the matrix.

In order to overcome this problem, it has been suggested to employ multiple remelting of the ingot produced to effect a further dissolution and diffusion of the molybdenum particles into the titanium matrix. Even after a series of multiple remelting steps, the resultant alloy is still characterized as being of a heterogeneous structure containing undissolved metallic molybdenum particles rendering such ingots unacceptable for the fabrication of mill products, such as rods, bars and tubes for use in corrosion resistant or structural applications.

The process of the present invention overcomes the problems and disadvantages associated with prior art techniques and enables the production of binary alloys, and particularly, titanium-base alloys incorporating about 15 to 30% molybdenum, which are characterized by the fact that the molybdenum is completely dissolved and substantially uniformly distributed throughout the binary alloy matrix, providing an ingot possessed of optimum mechanical properties, enabling the fabrication of mill products possessed of the requisite corrosion resistance and mechanical strength at commercially acceptable costs.

SUMMARY OF THE INVENTION

The benefits and advantages of the present invention are achieved by employing a semi-consumable electrode vacuum arc melting process for forming homogeneous binary alloys composed of a major amount of a first element, such as titanium or zirconium having a melting point below the liquidus of the binary alloy, and a minor amount of a second element, such as molybdenum, having a melting point above the liquidus of the binary alloy. The process has particular utility in producing titanium-based alloys containing about 5 to about 40%, and preferably, about 15 to about 30% molybdenum. The semi-consumable electrode is composed of the higher melting molybdenum element in the form of a bar, rod, ingot, or a compacted mass of molybdenum powder. The lower melting element, such as titanium, is fed, preferably in the form of titanium sponge, into a water-cooled copper mold or crucible, and is melted by the high-energy arc passing between the end of the electrode and the titanium, forming a molten pool. The titanium sponge is continuously fed at a controlled rate into the molten pool and is melted, while the power to the electrode is controlled so as to effect a controlled slower melting of the molybdenum electrode, whereby molten molybdenum droplets from the end of the electrode enter the molten pool, effecting a superheating thereof and become substantially completely and uniformly dissolved therein. A coordination of the feed rate of the titanium sponge and the power supplied to the electrode enables production of a homogeneous binary alloy ingot containing the desired proportion of the two alloying elements.

In accordance with one embodiment of the process, the electrode is mounted for movement relative to the surface of the molten pool so as to maintain the appropriate gap for the high-intensity electric arc. It is also contemplated that the electrode can be formed of a controlled cross-sectional area employing a crucible of a controlled cross-sectional area, whereby in consideration of the rate of feed of the titanium metal into the crucible, a controlled burn-off of the molybdenum electrode is effected at a lineal rate substantially corresponding to the rise of the level of molten metal in the crucible thereby automatically maintaining the desired arc gap, requiring little, if any, vertical adjustment of the electrode.

Additional advantages and benefits of the process comprising the present invention will become apparent upon a reading of the description of the preferred embodiments, taken in conjunction with the accompanying drawing.

DESCRIPTION OF THE PREFERRED EMBODIMENTS

The composition of the binary alloys as herein described and as set forth in the subjoined claims is expressed in terms of percentages by weight, unless clearly indicated to the contrary.

Figure 1:
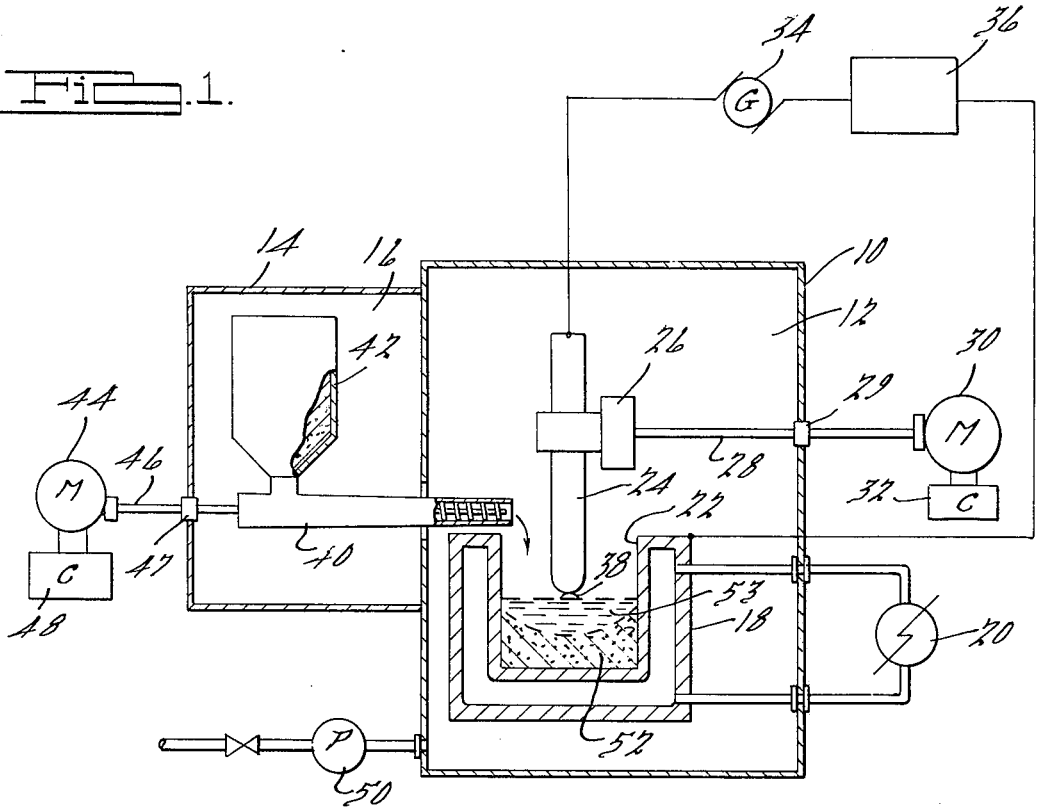
FIG. 1 comprises a schematic side elevational view, partly in section, of a suitable arrangement of the semi-consumable electrode vacuum arc melting process in accordance with one embodiment of the present invention.

Referring now in detail to the drawings, and as may be best seen in FIG. 1, a schematic arrangement of a vacuum arc melting furnace for use in the practice of the present process is illustrated including a housing 10 defining a vacuum furnace chamber 12 and a side housing 14 defining a vacuum feed chamber 16. Disposed within the vacuum chamber 12 is a crucible, such as a water-cooled copper mold 18, connected to a suitable heat exchanger 20 for circulating cooling water through a passageway formed within the mold wall to extract heat from the binary alloy being formed in a mold cavity 22. An electrode 24 composed of the high-melting element, such as molybdenum, is mounted for vertical movement on an electrode feed assembly 26 for adjusting the spacing or gap between the lower end of the electrode and the level of the molten pool in the cavity 22. Adjustment of the vertical disposition of the lower end of the electrode 24 may conveniently be achieved by a shaft 28 connected to the feed assembly 26 and drivingly coupled through a vacuum seal 29 to a motor 30, the operation of which is controlled by a motor controller 32.

The electrode 24 and the copper mold and the binary alloy contained therein are connected to a suitable source of electrical energy, such as a generator 34, and the voltage and electrical current supplied is controlled by a regulator 36 so as to maintain a high intensity electric arc, indicated at 38, of the desired power to effect a melting of the titanium feed material entering the mold cavity and a controlled melting or burn-off of the electrode 24.

The low melting element, such as titanium, is continuously fed to the mold cavity, preferably in the form of titanium sponge or other particulated form, by a suitable side feed mechanism, such as a screw conveyor 40 having a hopper 42 filled with the titanium feed material disposed within the vacuum feed chamber 16. The rate of feed of the titanium is appropriately controlled by a motor 44 drivingly coupled by a shaft 46 extending through a vacuum seal 47 to the screw conveyor, the operation of which is regulated by a motor controller 48. The interior of the vacuum chamber 12, as well as the feed chamber 16, can be appropriately evacuated by means of a vacuum pump 50 preliminary to the initiation of the arc melting process. Preferably, the interior of the vacuum and feed chambers is purged with an inert gas, such as argon, whereafter a vacuum is drawn of a magnitude conventionally employed in vacuum arc melting furnaces which may range from about $1 \times 10^{-3}$ to about $50 \times 10^{-3}$ Torr.

In accordance with the arrangement illustrated in FIG. 1, after evacuation of the chambers 12 and 14, an initiation of the semi-consumable electrode arc melting process is achieved by introducing titanium sponge into the base of the cavity 22 and positioning the end of the molybdenum electrode to strike an arc between the electrode and the titanium sponge, and then adjusting the position of the electrode to provide the desired arc gap. Electric power thereafter is supplied to the electrode to form the arc 38, effecting a melting of the titanium feed upon obtaining the melting point of titanium (1670° C), forming a molten pool or metal bath. As power is increased, the molten pool is slightly superheated and the temperature of the end of the electrode attains the melting point of molybdenum, whereby molten droplets of molybdenum enter the molten bath and become completely dissolved and uniformly distributed therein. The sensible heat of the molten molybdenum droplets entering the pool serves to superheat the molten titanium-rich alloy in the immediate vicinity of the droplet and, since the liquidus temperatures of binary alloys of molybdenum and titanium decrease continuously as the concentration of titanium increases, the liquidus temperature of the droplet decreases rapidly as it dissolves titanium, assuring complete miscibility of the two metals even though the temperature of the local region is decreasing toward the temperature of the bath. The sensible heat from the molybdenum droplets also tends to raise the temperature of the whole bath toward a level above the liquidus temperature of the alloy being produced. Ample time therefore is provided for the diffusion of molybdenum throughout the bath prior to solidification, a requisite for a uniform concentration of this element in the ingot. Titanium sponge in solid particulate form is continuously fed into the mold cavity at a controlled rate by the screw conveyor 40 and the power to the electrode and arc gap are controlled to effect a controlled burn-off or melting of the electrode so as to maintain a constant ratio of molten titanium and molten molybdenum entering the pool. As the level of metal increases, the position of the end of the electrode 24 is adjusted by the electrode feed assembly 26 as controlled by the motor 30 to maintain the appropriate arc gap. As the level of the alloy in the mold rises, the lower portion of the pool commences to solidify, forming a solid ingot indicated at 52, above which a parabolic-shaped molten pool, indicated at 53, of the binary alloy is maintained. Coordination and control of the energy input to the electrode and the feed rate of the titanium material to the mold cavity is continued until an ingot of the desired size is obtained. A mechanism suitable for providing a continuous electrode of compacted molybdenum powder suitable for use in the practice of the present process is disclosed in U.S. Pat. No. 2,656,743, the subject matter of which is incorporated herein by reference.

Figure 2:
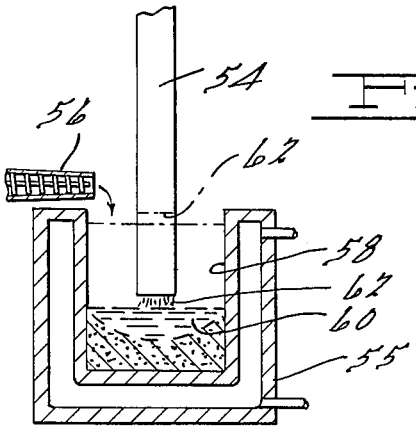
FIG. 2 is a fragmentary schematic side elevational view, partly in section, of an alternative satisfactory embodiment employing a substantially stationary electrode.

In accordance with an alternative embodiment of the present invention as shown in FIG. 2, once an arc has been established, the electrode 54 can be essentially stationarily supported relative to the crucible or mold cavity 55 and a side feed mechanism 56 is provided for introducing the particulated titanium into the mold cavity thereof. The cross-sectional area of the electrode 54 is of a predetermined magnitude in consideration of the cross-sectional area of the mold cavity 58 and the rate of the feed of the titanium material, whereby the lineal rate of consumption or burn-off of the electrode corresponds to the rate at which the level of the molten pool, indicated at 60, rises in the mold cavity so as to maintain an appropriate arc gap, indicated at 62, between the pool and the end of the electrode without requiring any or only minimal vertical adjustment of the electrode.

The position of the first level of the molten pool relative to the lower end of the electrode is indicated in solid lines in FIG. 2, while a second level of the molten pool and the electrode forming the gap 62 are indicated in phantom. Appropriate sizing of the electrode and the mold cavity relative to the rate of feed of the titanium can be made in consideration that molybdenum has a specific gravity of 10.2, while titanium has a specific gravity of 4.5. Accordingly, a binary titanium-molybdenum alloy containing about 30% molybdenum in the form of an ingot 20 inches in diameter weighs about 71 pounds per lineal inch, incorporating 50 pounds of titanium and 21 pounds of molybdenum. A bar of solid molybdenum about 8½ inches in diameter weighs 21 pounds per lineal inch. Therefore, in consideration of the foregoing parameters, if titanium is added at a controlled rate and the power to the arc is adjusted so that the arc gap remains constant, then as the level of the metal bath in the mold rises as the ingot builds up, 21 pounds of molybdenum will melt off for every 50 pounds of titanium that is fed and melted in the mold cavity. In accordance with the foregoing relationship, the arc gap is maintained substantially constant by adjusting the feed rate of the titanium sponge. If electrical characteristics indicate an increasing arc gap, the rate of feed of titanium is adjusted upward to close the gap, and if the electrical characteristics indicate a reduced arc gap, the rate of feed of titanium can be reduced to bring the arc gap back to the desired length. In this manner, only one control is necessary for the operator; this control is the rate of feed of titanium and this control is monitored by the arc current-arc voltage relationship.

While it will be apparent that the invention herein described is well calculated to achieve the benefits and advantages as set forth above, it will be appreciated that the invention is susceptible to modification, variation and change without departing from the spirit thereof.

What is claimed is:

1. A process for forming homogeneous binary alloys composed of a major amount of a first element having a melting point below the liquidus of said binary alloy and a minor amount of a second element having a melting point substantially above the liquidus of said binary alloy which comprises the steps of separately feeding said first element into a mold at a controlled rate, forming said second element into an electrode having one end thereof positioned within said mold adjacent to said first element, discharging a high energy electric arc between said electrode and said first element to effect a melting of said first element and said second element forming a molten pool, and feeding said first element and said second element to said mold at rates which are proportional to their concentration in the binary alloy desired.

2. The process as defined in claim 1 wherein the said first element is titanium and said second element is molybdenum.

3. The process as defined in claim 2 in which said binary alloys contains from about 5 to about 40% molybdenum.

4. The process as defined in claim 2 in which said binary alloy contains about 15 to about 30% molybdenum.

5. The process as defined in claim 2, in which the titanium is fed into said mold in the form of solid particles.

6. The process as defined in claim 2, in which the titanium is fed into said mold in the form of particulated sponge.

7. The process as defined in claim 2, in which said electrode is comprised of compacted particles of molybdenum.

8. The process as defined in claim 2, in which said electrode is comprised of a cast ingot of metallic molybdenum.

9. The process as defined in claim 1, including the further step of relatively moving said electrode and said mold to maintain an appropriate arc gap in response to the rise of the level of said binary alloy in said mold and the consumption of said electrode.

10. The process as defined in claim 1, including the further step of forming said electrode to provide a preselected cross-sectional area relative to the cross-sectional area of the cavity of said mold and controlling the energy of said arc and the feed of said first element to consume said electrode at a lineal rate corresponding substantially to the rate at which the level of said pool in said mold rises thereby maintaining an appropriate arc gap without vertical adjustment of said electrode relative to said mold.

11. A process for forming homogeneous alloys composed of a major amount of a reactive metal selected from the group consisting of titanium and zirconium and a minor amount of molybdenum which comprises the steps of separately feeding said reactive metal in a particulated form at a controlled rate into a water-cooled copper crucible, providing said molybdenum in the form of an electrode and striking an electric arc between said electrode and said reactive metal of sufficient intensity to melt the separately fed said reactive metal and to effect a simultaneous melting of said electrode at a controlled rate to supply all of the molybdenum content of said alloy having a prescribed molybdenum content, and feeding the said reactive metal and said molybdenum to said crucible at rates which are proportional to their concentrations in the alloy desired.

12. The process as defined in claim 11, in which said reactive metal is titanium.

* * * * *